United States Patent [19]

Herbst

[11] 3,934,750

[45] Jan. 27, 1976

[54] NON-DETACHABLE END UNIT

[75] Inventor: Edward J. Herbst, Posen, Ill.

[73] Assignee: Continental Can Company, Inc., New York, N.Y.

[22] Filed: Nov. 8, 1974

[21] Appl. No.: 521,995

[52] U.S. Cl. ..... 220/277; 220/268

[51] Int. Cl.[2] ..... B65D 41/02

[58] Field of Search ..... 220/266, 268, 269, 277; 222/541

[56] References Cited

UNITED STATES PATENTS

| | | | |
|---|---|---|---|
| 3,757,989 | 9/1973 | Brown | 220/269 |
| 3,794,206 | 2/1974 | DeLine et al. | 220/268 |
| 3,807,597 | 4/1974 | Wells et al. | 220/277 |

*Primary Examiner*—George T. Hall

*Attorney, Agent, or Firm*—John J. Kowalik; Joseph E. Kerwin; William A. Dittmann

[57] ABSTRACT

An improved non-detachable end closure has an outwardly facing dome-shaped opening flap. Non-detachable end closures, wherein the rivet for tab attachment is located in the center of the opening flap, may evidence low panel distortion under internal pressure. Forming the opening flap as an outwardly-facing dome provides increased distortion resistance and making the tab ring-shaped permits nesting of the ring in shielded location to prevent accidental opening. The arrangement of a dome within a well, which nests the ring tab, permits locating an expandable securing lug for the tab to the non-detachable dome panel within an upwardly widening space between the dome and interior of the ring tab. The structure makes the ring tab relatively inaccessible and inhibits the tendency of users who are familiar with current detachable ring pull tabs from pulling the tab off and encourages the user to push the tab inwardly.

10 Claims, 4 Drawing Figures

FIG. 1
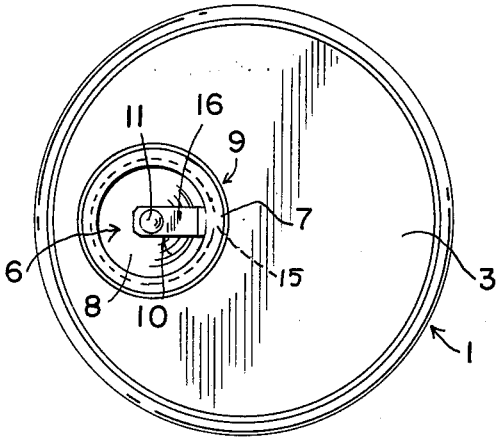
FIG. 2
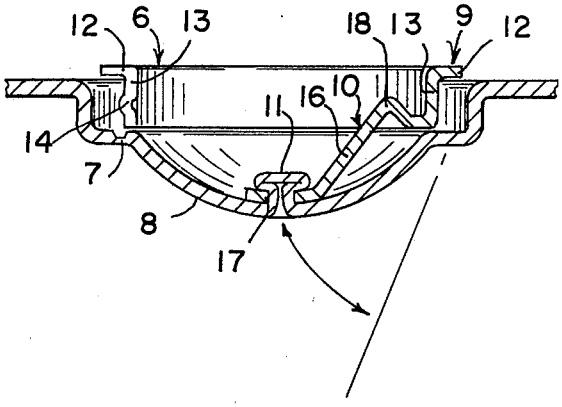
FIG. 3
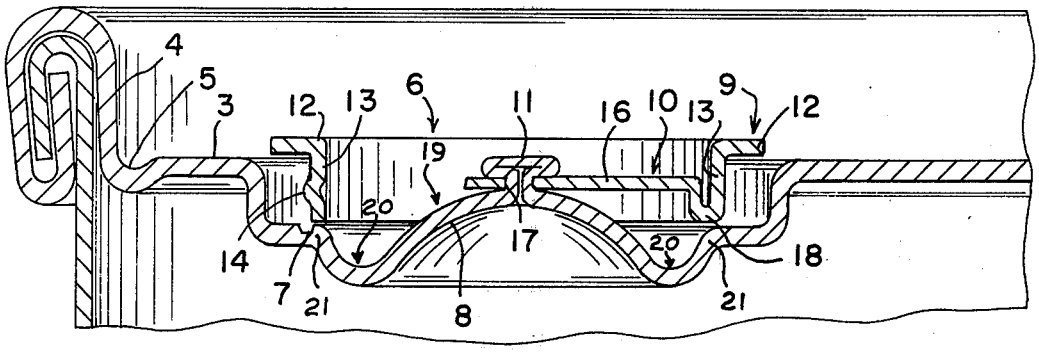
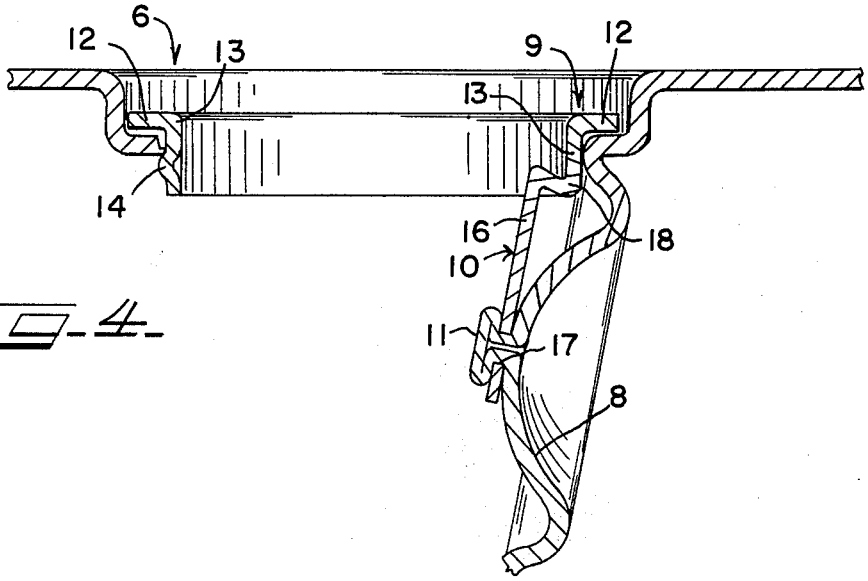
FIG. 4

NON-DETACHABLE END UNIT

SUMMARY OF THE INVENTION

Non-detachable end closures, of the type wherein the rivet for tab attachment is located in the center of the opening flap, may evidence low panel distortion under internal pressure. At present these opening flaps are formed as inwardly facing domes and the area around these domes is strengthened by coining as described in copending application, filed concurrently herewith, in the names of Harold Arnold Peyser and Edward J. Herbst and entitled End Panel Coining, docket number H-4081, Ser. No. 521,996, to raise the blow-out pressure. End closures formed in this manner can tolerate internal pressures of approximately 90–92 p.s.i. without distortion.

Forming the opening flap as an outwardly-facing dome increases the pressure tolerance to over 110 p.s.i. while eliminating the need for coining of the area around the wall. In addition, hinging is made easier and the flap may be opened further without insertion of the user's finger into the interior of the container. Further, use of the improved opening flap prevents the user from mistakenly lifting the tab with his finger in the manner of a conventional pull tab easy-open end closure.

DESCRIPTION OF THE DRAWINGS

The various features and advantages of the improved non-detachable end closure of this invention will be more apparent from the following detailed description when considered in connection with the accompanying drawing wherein:

FIG. 1 is a top view of the end closure.

FIG. 2 is a fragmentary cross-sectional view taken through the center of the opening flap, illustrating the prior art configuration.

FIG. 3 is a cross-sectional view similar to FIG. 2, illustrating the improved flap of this invention.

FIG. 4 is a cross-sectional view similar to FIG. 3, illustrating the end closure in the opened condition.

DESCRIPTION OF THE PREFERRED EMBODIMENT

There is illustrated a non-detachable end closure generally designated 1 having a chuck wall 4 joined to an end panel 3 by a chime 5. The end panel 3 is formed with a substantially vertically walled circular well 6 in an area between the end panel center and the chuck wall 4, said well 6 having at its base a score 7 partially encircling an opening flap 8. The unscored area provides a hinge portion 15 which connects the flap 8 with the end panel 3 when the flap 8 is torn away from the end panel 3 and pushed into the container.

The flap 8 is opened by a circular tab 9 which has a radial anchor lug 10 fastened to an integral rivet 11 formed in the center of the opening flap 8. The tab 9 comprises a tab flange 12 and a tab body 13, said tab body 13 having a retaining boss 14 diametrically opposite the anchor lug 10. The boss 14 serves to retain the tab 9 in the depressed position (FIG. 4) after the container is opened, the tab 9 shielding the sharp edge produced by breaking the score 7.

The anchor lug 10 comprises a strap 16 with rivet receiving hole 17 and an expansion hinge 18 integrally formed at the point of attachment to the tab body 13. The anchor lug 10 secures the tab 9 to the opening flap

8 which, in turn, is attached to the end panel 3 by the hinge portion 15. The possibility of the tab 9 becoming separated from the container after use and thereupon posing a litter problem is thus eliminated. The increased rigidity of the straight strap 16 insures that the tab 9 is held in close contact with the well floor 21, thereby preventing the user from mistakenly lifting the tab with his finger in the manner of a conventional pull tab easy-open end closure.

Formerly, the flap 8 was formed as an inwardly facing dome as shown in FIG. 2 and the periphery of the well 6 was coined as described in copending application, Ser. No. 521,996. End panels with the former configuration are usually capable of withstanding internal pressures of approximately 90–92 p.s.i. before buckling.

In the present invention, the flap 8 is formed as an outwardly facing dome 19, surrounded by an annular depression 20 of substantially U-shaped cross-section. The bottom of the depression 20 lies below the plane of the score 7 and allows the opening force on the flap edges to be taken in shear rather than tension, thereby eliminating the possibility of buckling of the flap 8 in the area immediately adjacent to the score 7. The top of the dome lies below the plane of the tab flange 12 and is shielded thereby, thus reducing the probability of unintended opening of the container during handling.

The improved end closure is usually capable of withstanding internal pressures in excess of 110 p.s.i. before buckling while eliminating the need for coining of the area around the well. In addition, the improved flap configuration makes hinging of the opened flap easier and allows the flap to be opened further without insertion of the user's finger into the interior of the container.

I claim:

1. An improved non-detachable end closure for a can or similar container comprising an end panel having a chuck wall joined to a body by a chime, said end panel being formed with a well in an area between the end panel center and said chuck wall, said well having a substantially vertical sidewall and a base, and a score formed in said base, defining and partially encircling an opening flap, said flap being formed as an outwardly projecting dome with a peripheral depression thereabout, said depression being defined by a U-shaped contour of said end panel and having a portion at one side merging into said dome and having another portion at its opposite side merging into said base.

2. The invention described in claim 1 wherein the bottom of said peripheral depression lies beneath the plane of said score.

3. The invention described in claim 1 and a tab disposed in fracturing relation to said score to effect opening of the container.

4. An improved non-detachable end closure for a can or similar container comprising an end panel having a chuck wall joined to a body by a chime, said end panel being formed with a well in an area between the end panel center and said chuck wall and terminating in a base, said base having a score partially encircling an opening flap, said flap being formed as an outwardly projecting dome with a peripheral annular depression, and a tab disposed in fracturing relation to said score to effect opening of the container, said tab having a radial anchor lug for attachment to said opening flap.

5. The invention described in claim 4 and an integral rivet formed in the center of said flap fastened to said anchor lug.

6. The invention described in claim 5 wherein said anchor lug is substantially L-shaped.

7. The invention described in claim 2 and an annular tab encompassing said dome and telescoped therewith.

8. The invention described in claim 7 wherein said tab has a lower edge and a radial expandable anchor lug extending therefrom and attached to the top of said dome.

9. The invention described in claim 8 wherein said dome has an integral rivet formed in the center of said flap serving as the attachment for the lug.

10. The invention described in claim 9 wherein said tab is shaped as a ring and said anchor lug is substantially L-shaped having a first leg between the ring and the dome and terminating in an upper end, and said leg having another leg extending from the upper end of the first leg radially of the ring and tangentially to the top of the dome.

* * * * *